United States Patent [19]

Johnson et al.

[11] 4,041,766

[45] Aug. 16, 1977

[54] SWAGING DEVICE FOR USE WITHIN A DIE APPARATUS

[75] Inventors: Robert Richard Johnson, Ludlow; Robert Arthur Coons, Pittsfield; John Andrew Zwald, York, all of Pa.

[73] Assignee: GTE Sylvania Incorporated, Stamford, Conn.

[21] Appl. No.: 692,445

[22] Filed: June 3, 1976

[51] Int. Cl.[2] ..... B21J 9/06

[52] U.S. Cl. ..... 72/402; 29/753

[58] Field of Search ..... 72/402, 452, 457, 399, 72/409, 410; 29/203 DT

[56] References Cited

U.S. PATENT DOCUMENTS

| | | | |
|---|---|---|---|
| 1,496,583 | 6/1924 | Lukes | 72/402 |
| 3,086,574 | 4/1963 | Ustin | 72/402 |
| 3,170,501 | 2/1965 | Ustin | 72/402 |

FOREIGN PATENT DOCUMENTS

| | | | |
|---|---|---|---|
| 674,205 | 11/1963 | Canada | 72/402 |
| 1,188,156 | 3/1959 | France | 72/402 |
| 1,268,289 | 6/1961 | France | 72/402 |

*Primary Examiner*—C.W. Lanham
*Assistant Examiner*—Gene P. Crosby
*Attorney, Agent, or Firm*—Norman J. O'Malley; Lawrence R. Fraley; Donald R. Castle

[57] ABSTRACT

An improved swaging device is described which is incorporated within a die apparatus and adapted for operating in conjunction therewith. The device comprises a housing which includes an upstanding substantially annular portion defining a plurality of open channels therein, a plurality of swaging members each oriented within one of the annular portion's channels, and an acutation member adapted for rotational movement about the housing's annular portion to concurrently activate the swaging members and effect a swage on a wire intermittently passing through said die apparatus.

9 Claims, 9 Drawing Figures

SWAGING DEVICE FOR USE WITHIN A DIE APPARATUS

BACKGROUND OF THE INVENTION

The invention relates to devices for swaging wire. More particularly, the invention relates to wire swaging devices which are incorporated within a die apparatus and adapted for operating in conjunction therewith.

A typical use for combined swaging and die operations is in the manufacture of electrical contacts. Such contacts, particularly those utilized in printed circuit board (PCB) connectors, are produced from relatively small, e.g. 0.025 inch square, metallic wire. As this wire is intermittently passed through the die apparatus, portions of the wire may be flattened to define the desired tine portions for each contact. Each of these tine portions may then be subsequently formed into various configurations, said operations also occurring within the die apparatus.

Incorportion of a swaging device within a larger die apparatus provides a means whereby added operations can be performed on the wire, particularly those portions not subjected to the previously described flattening operation. With particular regard to the present invention, it is possible to provide segments of the unflattened portions of the wire with features such as indentations, protrusions, etc. These features in turn define the retention portion of each electrical contact produced. The retention portion of an electrical contact provides positive retention of said contact within the PCB connector's insulative housing.

Consolidating the aforementioned die and swaging operations into one location also substantially reduces the total work area required for producing electrical contacts in addition to the number of personnel needed to oversee these various operations.

Known prior art methods for incorporating a swaging device within a die apparatus have usually involved use of an upper tool joined to but separate from the upper shoe typically utilized in most die apparatus. A lower tool was also required, said tool joined to but separate from the lower base member of the die apparatus. Additionally, two separate horizontally aligned slide tools were necessary, said tools being positioned perpendicularly to each other. This slide tooling was usually actuated by cam members mounted within the upper shoe of the apparatus.

Because the aforementioned four tooling components were separately positioned within the die apparatus and often operated in opposing directions, alignment and timing of these members was especially difficult to maintain. Furthermore, because said tooling was located in the manner defined, adjustment became excessively time consuming and usually required a complete shut-down to the die apparatus.

It is believed therefore that an improved swaging device capable of being incorporated within a die apparatus for operation in conjunction therewith wherein said device facilitates such operations as alignment, timing, and repair thereof would constitute an advancement in the art.

OBJECTS AND SUMMARY OF THE INVENTION

It is therefore a primary object of this invention to provide an improved swaging device for use within a larger die apparatus.

It is another object of this invention to provide a device of the nature described which will facilitate alignment, timing, and repair thereof over known prior art devices.

In accordance with one aspect of the invention, there is provided an improved swaging device for use within a larger die apparatus and capable of operating in conjunction therewith. The device swages a wire intermittently passing through the die apparatus and includes a housing secured to the die's lower base, a plurality of swaging members movably positioned within an upstanding annular portion of said housing, and a rotational actuation member operatively connected to the die's upper movable shoe member for concurrently actuating each of said swaging members. When actuated, each of the swaging members concurrently and positively engage the wire to effect the desired swage thereof.

DETAILED DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
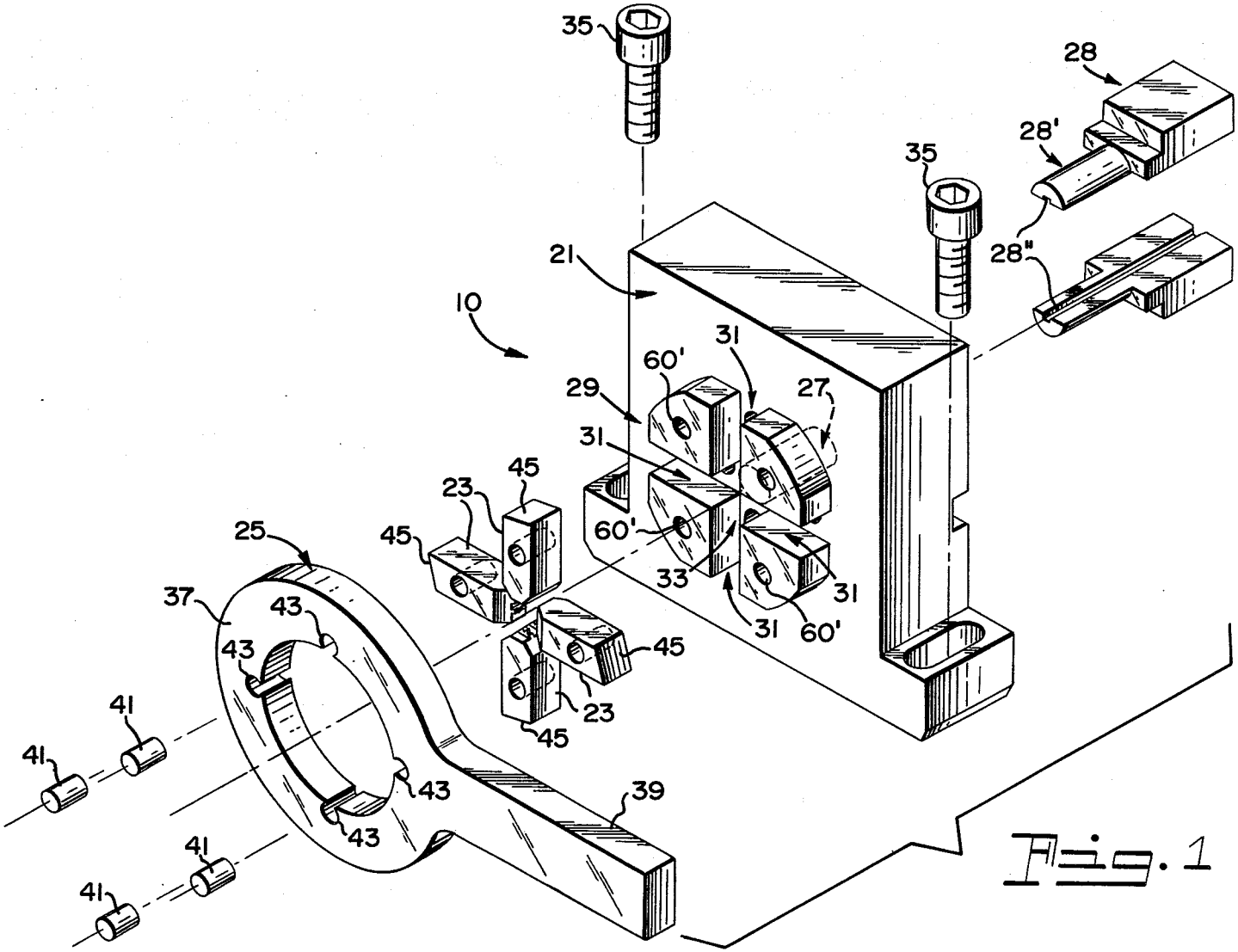
FIG. 1 is an exploded isometric view of an improved swaging device in accordance with a preferred embodiment of the invention.

With particular reference to the drawings, there is shown in FIG. 1 a swaging device 10 in accordance with a preferred embodiment of the invention. Device 10 is incorporated within a die apparatus 13 (FIGS. 2 and 3) including a stationary lower base member 15 and a movable upper shoe or ram member 17. As will be explained, device 10 operates in conjunction with die apparatus 13 to swage a wire 19 as the wire intermittently passes through die 13.

Figure 9:
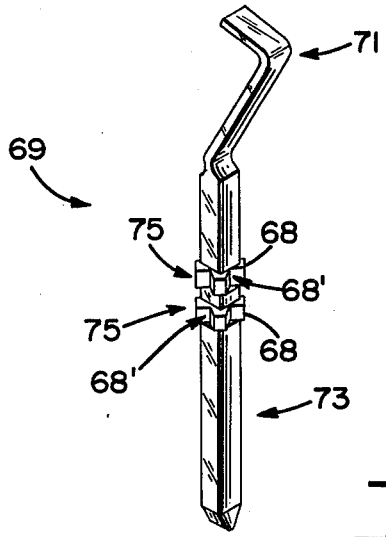
FIG. 9 is an isometric view of an electrical contact having the swaged configuration shown in FIG. 8 thereon.

Wire 19 is preferably rectangular, e.g. 0.025 inch square, in cross-sectional configuration. It is of course understood that wire 19 may be round or of a configuration other than that depicted in the drawings. As previously mentioned, wire 19 may eventually be formed to define at least one electrical contact. Accordingly, wire 19 is subjected to a series of flattening and forming operations within die apparatus 13. Swaging device 10 thus functions to define the retention portion of the electrical contact on that portion of wire 19 not subjected to the aforementioned operations. When manufacturing several contacts from wire 19, the wire is segmented subsequent to these operations with each segment defining the contact. An example of one such contact is shown in FIG. 9.

Swaging device 10 comprises a housing 21 secured to lower base 15 of the die apparatus, a plurality of swaging members 23, and an actuation member 25. Housing 21 defines a first opening 27 therein for permitting wire 19 to pass therethrough when the wire is intermittently passing through apparatus 13. To facilitate alignment of wire 19 as the wire passes through device 10, a guide means 28 may be provided. Guide 28 includes an upstanding substantially cylindrical portion 28' which is press-fit within first opening 27 in housing 21. A rectangular slot 28'' is provided within guide 28 to accommodate wire 19.

Figure 4:
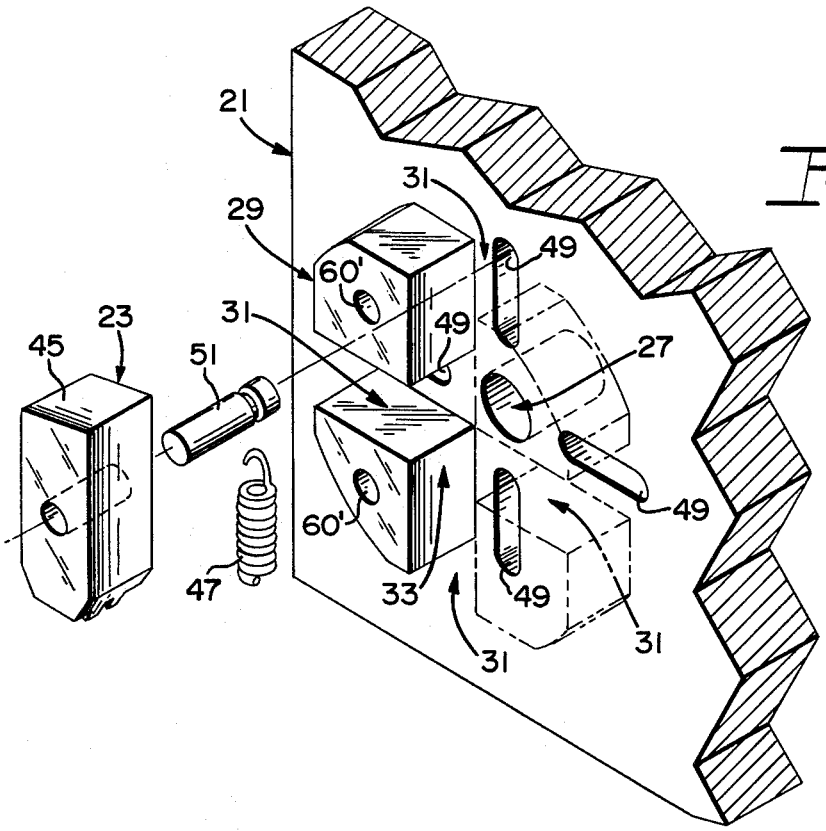
FIG. 4 is an enlarged isometric view, partly in section, illustrating the positioning of one of the swaging members of the invention within the device of FIG. 1.

Housing 21 also includes an upstanding substantially annular portion 29 which includes therein a plurality of spacedly positioned open channels 31. Annular portion 29 defines a second opening 33 therein which is in communication with first opening 27 and which also permits wire 19 to pass therethrough. Both of the above openings 27 and 33 are clearly illustrated in FIG. 4. Housing 21 is secured to lower base member 15 using retention bolts 35.

Each of the swaging members 23 is movably positioned within one of the open channels 31 of annular portion 29 to positively engage wire 19 to effect the desired swage thereof. This occurs when members 23 are concurrently actuated by actuation member 25 in a manner to be described.

As stated, swaging members 23 are concurrently actuated by member 25 and thus each positively engage wire 19 at the same time. This form of engagement constitutes one of the key features of the invention because prior art swaging mechanisms required several sequential engagements of the wire in order to accomplish an effective swage thereof. The concurrent actuation of swaging members 23 and the subsequent concurrent positive engagement of wire 19 by these members is illustrated in FIGS. 2, 3, 7 and 8.

Figure 2:
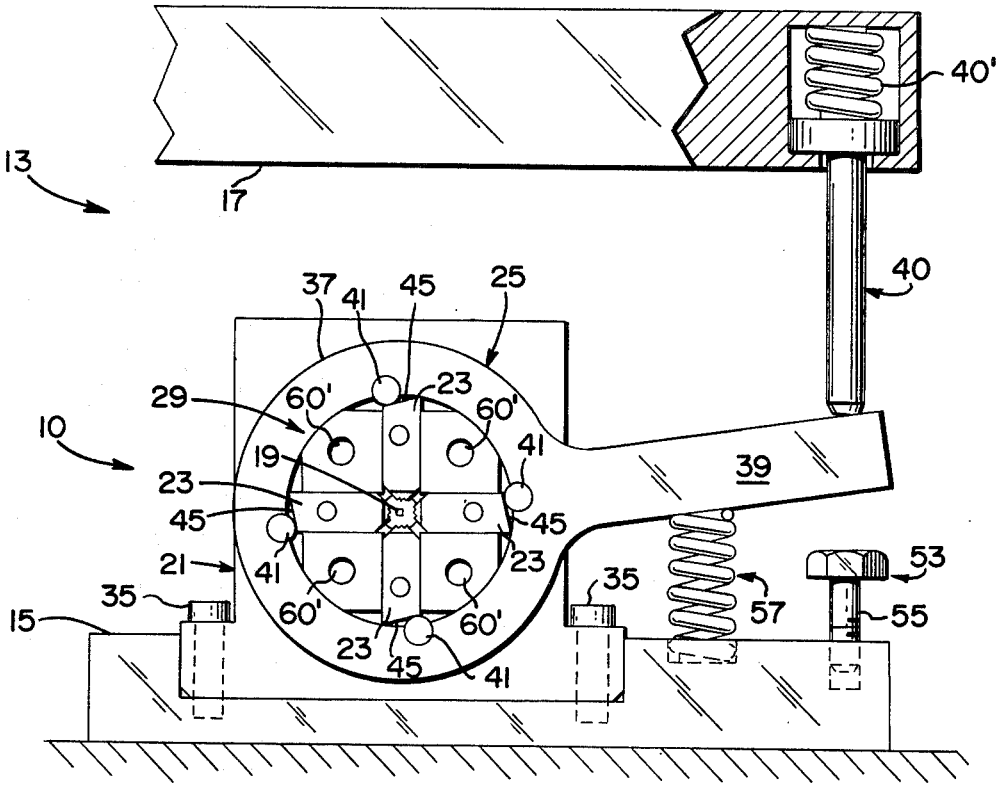
FIGS. 2 and 3 illustrate the various positioning relationships of the swaging device of FIG. 1 within a die apparatus.
Figure 3:
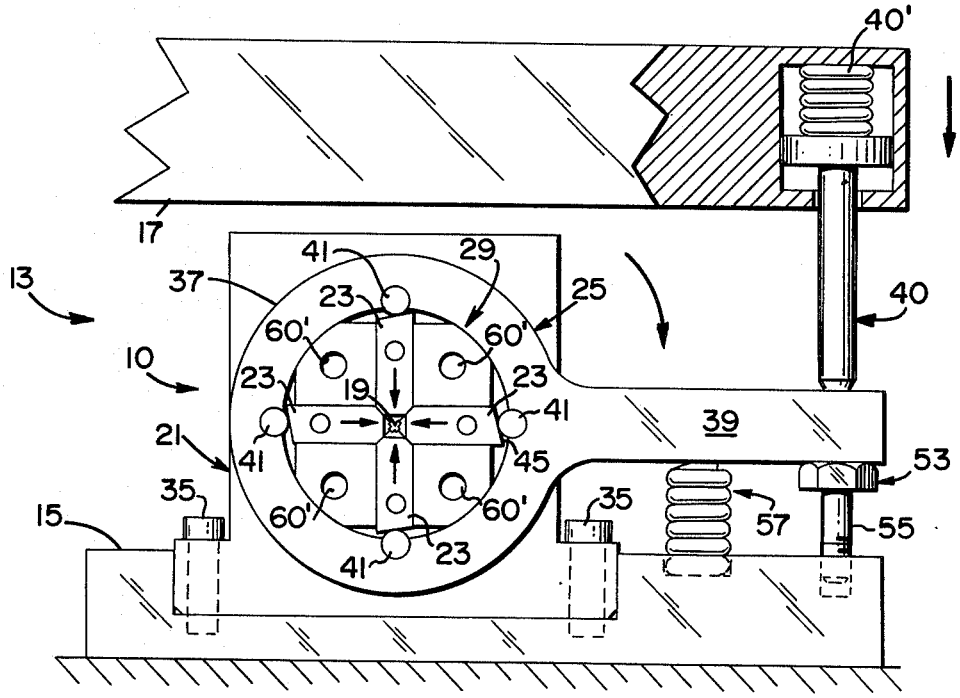

Actuation member 25 comprises a substantially annular body portion 37 which is rotatively oriented about upstanding annular body portion 29 and an extending arm portion 39 which extends from body 37 and is operatively connected to upper shoe member 17 of die 13. As shown in FIGS. 2 and 3, actuation member 25 rotatively moves about upstanding annular portion 29 in conjunction with the reciprocal movement of upper shoe member 17 to concurrently actuate each of the swaging members 23 within channels 31. In doing so, members 23 in turn positively engage wire 19 to effect the desired swage thereof. The downward rotative movement or stroke of arm 39 is accomplished when an engagement member 40, positioned within upper shoe 17, engages arm 39 and forces it in the direction indicated during the downward motion of shoe 17. To prevent deformation of arm 39, it is preferred that member 40 be resiliently located within upper shoe 17. A spring 40' is therefore provided to bias member 40 downward in the manner indicated, thus assuring continuous engagement between arm 39 and member 40.

The preferred number of open channels 31 within upstanding annular portion 29 of housing 21 is four, said channels disposed at approximately 90° intervals about second opening 33. Accordingly, four swaging members 23 are also preferably utilized, each of said members 23 oriented within one of the channels 31. The above positioning relationship assures that wire 19 will be engaged on four opposing sides thereof, said engagement facilitating the desired swage operations.

To facilitate actuation of swaging members 23 by member 25, a plurality of cylindrical engagement pins 41 are spacedly positioned within body portion 37 of member 25 in alignment with each of said members 23. Pins 41 are preferably press-fitted within substantially cylindrical openings 43 in body portion 37. Each may be loosely positioned in said openings in order to individually rotate during the actuation sequence. When utilizing four channels 31 and four corresponding swaging members 23, it is understood that four pins 41 are employed. Accordingly, each pin 41 engages one swaging member 23 and forces it inwardly within channel 31 toward wire 19 as the wire passes through second opening 33. Completed rotative movement of member 25, as depicted in FIG. 3, shows the swaging members fully engaging wire 19 to accomplish the swage thereof.

With further reference to FIGS. 2 and 3, each of the pins 41 maintains continuous engagement with a respective swage member 23 during the rotative movement of actuation member 25. Pins 41 thus provide the inward displacement of swage members 23 during the downward stroke of arm 39 and permit return of members 23 during the upward or return stroke of the arm. To facilitate this actuation, each of the swage members 23 includes an angular end surface 45 upon which one of the pins 41 rides.

Return of the swage members 23 during the upward stroke of arm 39 is assured by providing each member 23 with a spring 47 (FIG. 4) which biases the member outwardly. Each spring 47 is operatively joined to one of swaging members 23 and in turn is positioned within a recess 49 located within housing 21 relative to one of the channels 31. Each swage member 23 includes an extension pin 51 to which spring 47 may be secured. Accordingly, it is understood that springs 47 bias swage members 23 away from wire 19 when actuation member 25 is not actuating members 23.

An adjustable stop 53 (FIGS. 2 and 3) is provided within lower base 15 and die 13 in alignment with arm 39 for engaging the arm during the aforementioned rotative movement and thus define the extent of movement thereof. Stop 53 is preferably a bolt 55 screwed into base 15 which can be easily adjusted during operation of device 10 to define the amount of downward stroke.

When utilizing the engaging relationship between arm 39 and engagement member 40 of upper shoe 17 depicted in FIGS. 2 and 3, a spring 57 is preferably used to provide upward return movement of the arm. Spring 57 is preferably secured within lower base 15 and thus aligns with arm 39. Spring 57 is required in this arrangement because arm 39 is not mechanically joined to upper shoe 17. It is understood, however, that arm 39 and upper shoe 17 can be mechanically connected utilizing some form of linkage member, e.g. connecting rod. Should this arrangement be utilized, spring 57 may be removed. Such a linkage member could further include an adjustment means therein which in turn would eliminate the necessity for adjustable stop 53. However, because an adjustment means within a linkage arm would be relatively difficult to adjust during operation of device 10, the arrangement depicted in FIGS. 2 and 3 is preferred.

Figure 5:
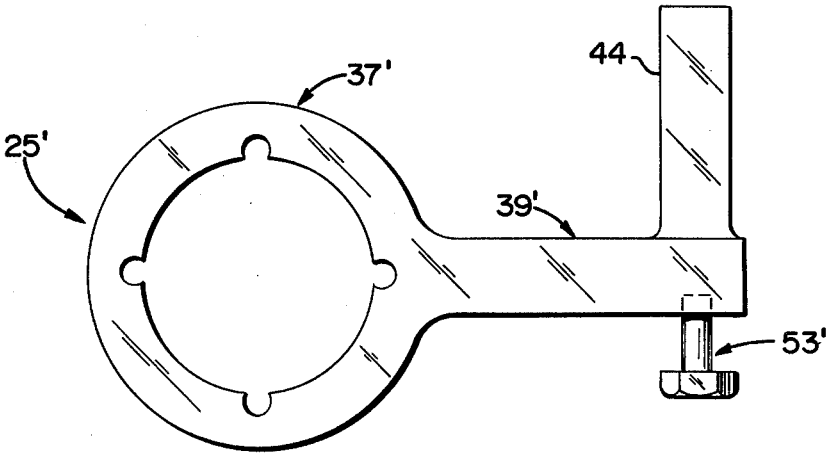
FIG. 5 represents an alternate embodiment of the actuation member of the invention.

There is shown in FIG. 5 an alternate embodiment of an actuation member for use with the invention. Actuation member 25' includes an annular body portion 37' substantially similar to body portion 37 of member 25 (FIG. 1). Arm portion 39' of member 25' includes as an integral part thereof an engagement portion 44 and an adjustable portion 53'. When using this embodiment for member 25', it is understood that spring 57 (FIGS. 2 and 3) is also utilized to provide return movement for arm 39'.

Figure 6:
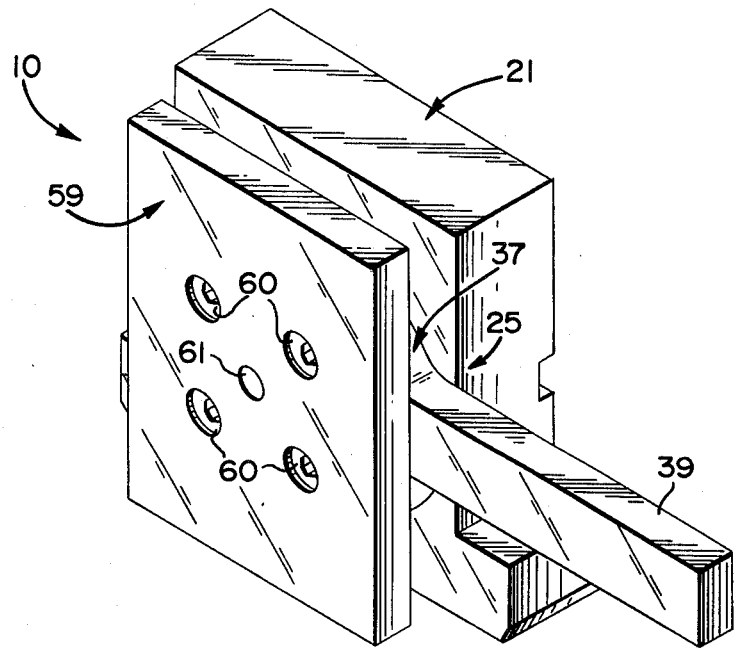
FIG. 6 is an isometric view of the device of FIG. 1 including a cover member thereon.

Device 10 is shown in FIG. 6 as being completely assembled and ready for use within die apparatus 13. Device 10 also preferably includes a cover member 59 which is secured to upstanding annular portion 29 of housing 21 using a plurality of screws 60. Each of screws 60 are positioned within a corresponding opening 60' provided within annular portion 29 (FIGS. 1–4). Cover 59 substantially covers body portion 37 of actuation member 25 and the swaging members 23 located within channels 31 of the device's housing. To permit passage of wire 19, cover 59 includes therein a third opening 61 which aligns with second opening 33 within annular portion 29. The function of cover 59 may be twofold. In addition to protecting many of the internal components of device 10 from undesirable particles, e.g. dust, dirt, etc., cover 59 can also be used to maintain pins 41, swaging members 23, and actuation member 25 in their respective positions within device 10.

Figure 7:
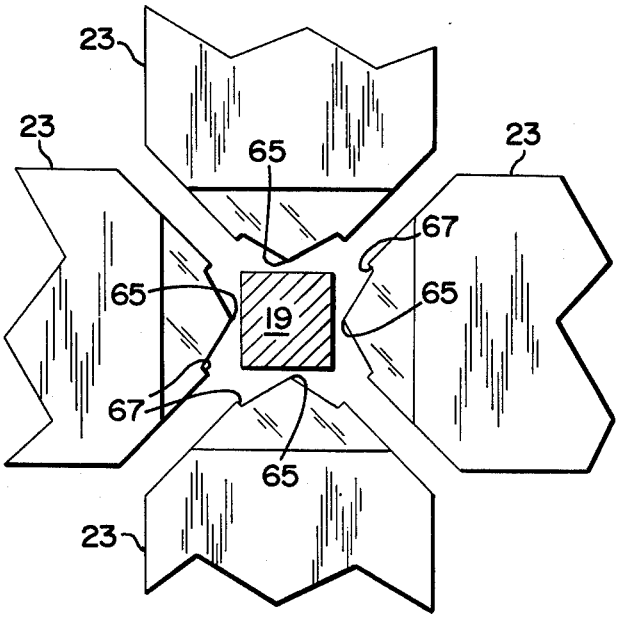
FIGS. 7 and 8 illustrate the steps in effecting a swage configuration on a wire when using the swaging device of the invention.
Figure 8:
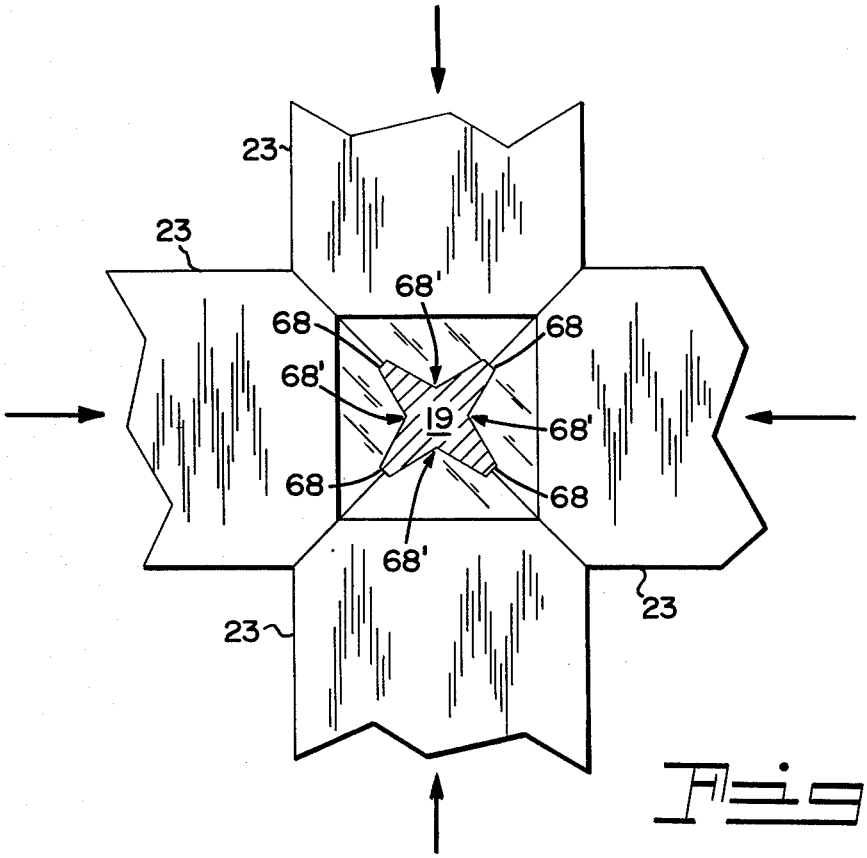

FIGS. 7 and 8 depict the preferred sequence of operation for effecting a swage on wire 19. Each of the swage members 23 is provided with a pointed tip 65 and a corresponding pair of defining end surfaces 67. The resulting swaged portion of wire 19 includes a plurality of protruding tip portions 68 and a corresponding plurality of indented portions 68. It is understood that the positioning of members 23 shown in FIG. 7 corresponds to the position of actuation member 25 in FIG. 2 while the positioning in FIG. 8 corresponds to the position of member 25 shown in FIG. 3.

In FIG. 9 is illustrated a completed electrical contact 69 including a tine portion 71 and a tail portion 73. Tine portion 71 has been subjected to the aforementioned flattening and defining operations within die apparatus 13. Similarly, tail portion 73 has been provided with at least two distinctive swaged portions 75 by the aforementioned swaging process. As further mentioned, swaged portions 75 define the retention portion for contact 69, said retention portion assuring retention of the contact within an insulative connector housing. Each swaged portion is shown as including the tip portions 68 and corresponding indented portions 61.

Thus there has been shown and described an improved swaging device for incorporation within a die apparatus and adapted for operation in conjunction therewith. The device provides a wire intermittently passing through the die with a desired swage configuration.

While there has been shown and described what are at present considered the preferred embodiments of the invention, it will be obvious to those skilled in the art that various changes and modifications may be made therein without departing from the scope of the invention as defined by the appended claims.

What is claimed is:

1. In a die apparatus including a stationary lower base member and a movable upper shoe member and incorporating a swaging device therein operating in conjunction with said die apparatus for swaging a wire intermittently passing through said die apparatus, the improvement wherein said swaging device comprises:

a housing secured to said stationary lower base member of said die apparatus, said housing having a first opening therein for permitting said wire to pass therethrough and having an annular portion projecting therefrom in alignment with said first opening, said annular portion having a plurality of spacedly and radially positioned channels therein, said channels at their inner ends meeting to form a second opening aligned with the first opening and in communication therewith, a swaging member slidably carried in each of the aforesaid channels, the inner end of each swaging member being configured to cooperate with that of the other swaging members to produce the desired swaging action, the outer end of each swaging member having a cam surface shaped to provide the desired travel of the swaging member in its channel, an actuator comprising a substantially annular body having its inner circular surface fitting over the outer surface of the annular portion projecting from the housing for rotation thereabout, a plurality of cylindrical pins carried by the annular body and positioned for alignment with the swaging members, a portion of the outer cylindrical surface of each pin extending beyond the inner surface of the annular body to engage the cam surface of its respective swaging member, and an arm extending from the annular body and operatively connected to the movable upper shoe member of said die apparatus, whereby upon downward movement of the upper shoe member the actuator arm is moved so as to cause the actuator body to rotate about the annular portion projecting from the housing thereby causing the pins to move over their respective cam surfaces to drive the swaging member inwardly to deform the wire.

2. The improvement according to claim 1 wherein the number of said open channels within said upstanding annular portion of said housing is four, said channels disposed at approximately 90° intervals about said second opening defined by said annular portion.

3. The improvement according to claim 2 wherein the number of said swaging members is four.

4. The invention as set forth in claim 1 and wherein the cylindrical pins are sized to fit rotatably in the annular body so that they will rotate upon engaging the cam surface on the swaging members to reduce wear.

5. The improvement according to claim 4 including a plurality of springs spacedly positioned within said housing, each of said springs operatively joined to one of said swaging members for providing movement of said swaging members away from said wire when said actuation member is not actuating said swaging members.

6. The improvement according to claim 4 further including an adjustable stop positioned within said lower base member of said die apparatus in alignment with said extending arm portion of said actuation member for engaging said arm portion during said rotative movement of said actuation member to define the extent of movement thereof.

7. The improvement according to claim 4 further including an engagement member positioned within said movable upper shoe member of said die apparatus, said engagement member engaging said extending arm portion of said actuation member to effect said rotative movement of said actuation member.

8. The improvement according to claim 7 further including a cover member secured to said body portion of said actuation member to substantially cover said swaging members within said open channels, said cover defining a third opening therein for permitting said wire to pass therethrough, said third opening in alignment with said second opening defined by said upstanding annular portion of said housing.

9. The improvement according to claim 8 further including a spring member secured to said lower base member at said housing and operatively joined to said extending arm portion of said actuation member for assisting said rotative movement of said actuation member.

* * * * *